US010093121B2

(12) United States Patent
Nobe et al.

(10) Patent No.: US 10,093,121 B2
(45) Date of Patent: Oct. 9, 2018

(54) SHEET BINDING DEVICE AND SHEET POST-PROCESSING APPARATUS

(71) Applicant: FUJI XEROX CO., LTD., Tokyo (JP)

(72) Inventors: Yutaka Nobe, Kanagawa (JP); Satoshi Kurihara, Kanagawa (JP); Hiroaki Awano, Kanagawa (JP); Yoshinori Nakano, Kanagawa (JP); Takuya Makita, Kanagawa (JP); Katsumi Harada, Kanagawa (JP); Kojiro Tsutsumi, Kanagawa (JP); Takashi Ogino, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/599,795

(22) Filed: May 19, 2017

(65) Prior Publication Data

US 2018/0015768 A1 Jan. 18, 2018

(30) Foreign Application Priority Data

| | | |
|---|---|---|
| Jul. 14, 2016 | (JP) | 2016-139807 |
| Jul. 14, 2016 | (JP) | 2016-139808 |
| Jul. 14, 2016 | (JP) | 2016-139809 |
| Jul. 14, 2016 | (JP) | 2016-139810 |
| Nov. 14, 2016 | (JP) | 2016-221551 |

(51) Int. Cl.

| | |
|---|---|
| ***B31F 1/07*** | (2006.01) |
| ***B42B 5/10*** | (2006.01) |
| ***B31F 5/02*** | (2006.01) |
| ***B42C 1/12*** | (2006.01) |
| ***B65H 37/04*** | (2006.01) |
| ***B42B 5/00*** | (2006.01) |
| ***G03G 15/00*** | (2006.01) |

(Continued)

(52) U.S. Cl.

CPC ..... *B42B 5/106* (2013.01); *B31F 5/02* (2013.01); *B42B 5/00* (2013.01); *B42C 1/125* (2013.01); *B65H 37/04* (2013.01); *G03G 15/6544* (2013.01); *B42B 5/08* (2013.01); *B42C 1/12* (2013.01); *B42F 3/04* (2013.01); *B65H 2301/51616* (2013.01); *G03G 2215/00822* (2013.01)

(58) Field of Classification Search

CPC ..... B31F 1/07; B31F 5/02; B31F 2201/0712; B65H 37/04; B65H 2301/43828; B65H 2301/51616; G03G 15/6544; G03G 2215/00852

USPC ..... 270/58.08

See application file for complete search history.

(56) References Cited

U.S. PATENT DOCUMENTS

| | | | | |
|---|---|---|---|---|
| 8,333,372 | B2 * | 12/2012 | Awaya | B65H 37/04 270/58.07 |
| 2015/0353316 | A1 * | 12/2015 | Abe | B65H 37/04 270/58.08 |
| 2016/0107409 | A1 * | 4/2016 | Kubo | B31F 1/07 412/33 |

FOREIGN PATENT DOCUMENTS

| | | | |
|---|---|---|---|
| JP | 2009-051661 | A * | 3/2009 |
| JP | 2011-201654 | A | 10/2011 |
| JP | 2016-159456 | A * | 9/2016 |

* cited by examiner

*Primary Examiner* — Leslie A Nicholson, III
(74) *Attorney, Agent, or Firm* — Sughrue Mion, PLLC

(57) ABSTRACT

A sheet binding device includes a first tooth-shaped member that has plural arranged teeth, and a second tooth-shaped member that has plural arranged teeth, bites the first tooth-shaped member to clamp and bind sheets in cooperation (Continued)

with the first tooth-shaped member, and is tilted relative to the first tooth-shaped member from a beginning of biting to a completion of biting.

9 Claims, 15 Drawing Sheets

(51) Int. Cl.
*B42B 5/08* (2006.01)
*B42F 3/04* (2006.01)

SHEET BINDING DEVICE AND SHEET POST-PROCESSING APPARATUS

CROSS-REFERENCE TO RELATED APPLICATIONS

This application is based on and claims priority under 35 USC 119 from Japanese Patent Application No. 2016-139807 filed Jul. 14, 2016, No. 2016-139808 filed Jul. 14, 2016, No. 2016-139809 filed Jul. 14, 2016, No. 2016-139810 filed Jul. 14, 2016, and No. 2016-221551 filed Nov. 14, 2016.

BACKGROUND

(i) Technical Field

The present invention relates to a sheet binding device and a sheet post-processing apparatus.

(ii) Related Art

There is known a recording-material binding device in which plural stacked recording materials are joined together by being clamped, pressurized, and deformed in a wavy form by a pair of tooth-shaped members each having a tooth row.

SUMMARY

According to an aspect of the invention, there is provided a sheet binding device including a first tooth-shaped member that has plural arranged teeth, and a second tooth-shaped member that has plural arranged teeth, bites the first tooth-shaped member to clamp and bind sheets in cooperation with the first tooth-shaped member, and is tilted relative to the first tooth-shaped member from a beginning of biting to a completion of biting.

BRIEF DESCRIPTION OF THE DRAWINGS

An exemplary embodiment of the present invention will be described in detail based on the following figures, wherein.

DETAILED DESCRIPTION

Figure 1:
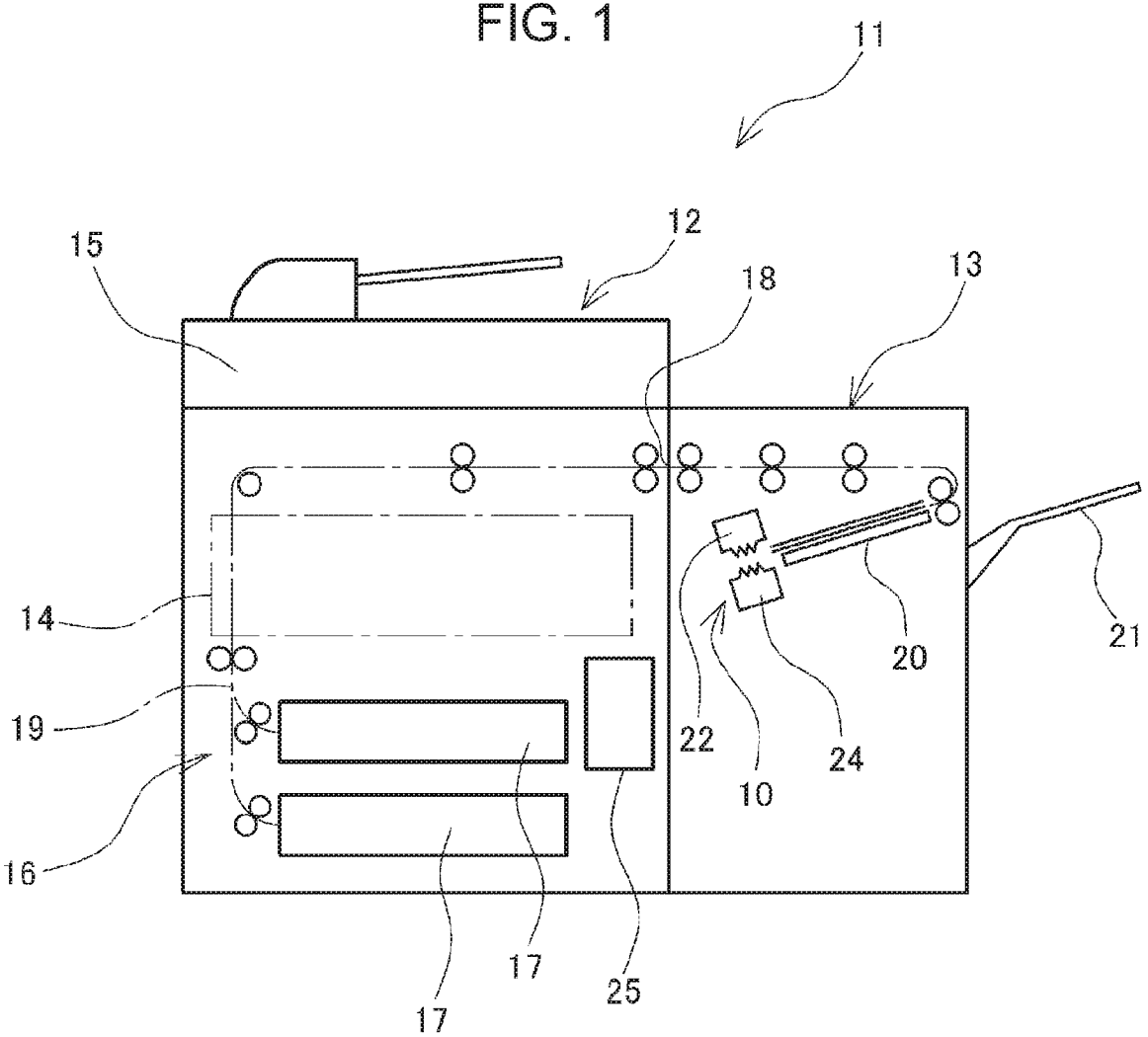
FIG. 1 is a schematic view illustrating a general configuration of an image forming system.

An exemplary embodiment of the present invention will be described below with reference to the drawings. FIG. 1 is a schematic view illustrating a general configuration of an image forming system 11 including a recording-material binding device 10 according to the exemplary embodiment. The image forming system 11 includes an image forming apparatus 12 having a printing function and a copying function using, for example, electrophotography, and a recording-material post-processing apparatus 13 that conducts post processing, for example, punching and binding, on recording materials after images are formed thereon in the image forming apparatus 12. The recording-material binding device 10 of the exemplary embodiment may be installed in the recording-material post-processing apparatus 13.

The image forming apparatus 12 includes an image forming section 14 that forms a toner image on the basis of acquired document information. The document information may be acquired by reading a document with a document reading unit 15 provided in the image forming apparatus 12, or may be acquired from an external apparatus. The image forming apparatus 12 further includes a recording-material feeding mechanism 16. Recording materials to be fed are recording materials having a predetermined shape, for example, sheet-like recording materials cut in a rectangular shape. The recording materials are made of, for example, paper. The recording-material feeding mechanism 16 includes supply trays 17 that hold stacked recording materials, and a transport path 19 through which the recording materials are transported from the supply trays 17 to an output port 18. In a process of being transported through the transport path 19, a recording material receives a toner image formed in the image forming section 14, and the toner image is fixed thereon. The recording material sent out from the output port 18 is received by the recording-material post-processing apparatus 13.

In the recording-material post-processing apparatus 13, received recording materials are stacked on an accumulation tray 20 to form a recording material bundle, as required. When accumulation is unnecessary, the recording materials are output into an output tray 21. When a predetermined number of recording materials are accumulated on the accumulation tray 20, the recording materials are subjected to post processing such as punching and binding. The recording-material binding device 10 performs post processing for binding the recording materials. The recording-material binding device 10 includes a pair of two tooth-shaped members 22 and 24 in each of which plural teeth are arrayed. To distinguish the two tooth-shaped members, for convenience, the tooth-shaped member located on an upper side of FIG. 1 is referred to as an upper tooth-shaped member 22, and the tooth-shaped member located on a lower side of FIG. 1 is referred to as a lower tooth-shaped member 24. It is only required that the two tooth-shaped members 22 and 24 should be opposed to each other with recording materials to be bound being interposed therebetween, and, for example, the tooth-shaped members may be arranged in the right-left direction.

Both or one of the upper tooth-shaped member 22 and the lower tooth-shaped member 24 is advanced or retreated relative to the other tooth-shaped member by a driving mechanism. When both or one of the upper tooth-shaped member 22 and the lower tooth-shaped member 24 advances, the upper tooth-shaped member 22 and the lower tooth-shaped member 24 bite each other. When the upper tooth-shaped member 22 and the lower tooth-shaped member 24 bite each other, recording materials clamped therebetween are deformed in a wavy form, joined, and bound. After bound, the recording materials are output to the output tray 21.

The image forming system 11 further includes a controller 25 that controls operations of parts and mechanisms in the image forming apparatus 12 and the recording-material post-processing apparatus 13. The controller 25 acquires a request from the user, and controls the operations of the parts of the image forming system 11 according to the request.

Figure 2:
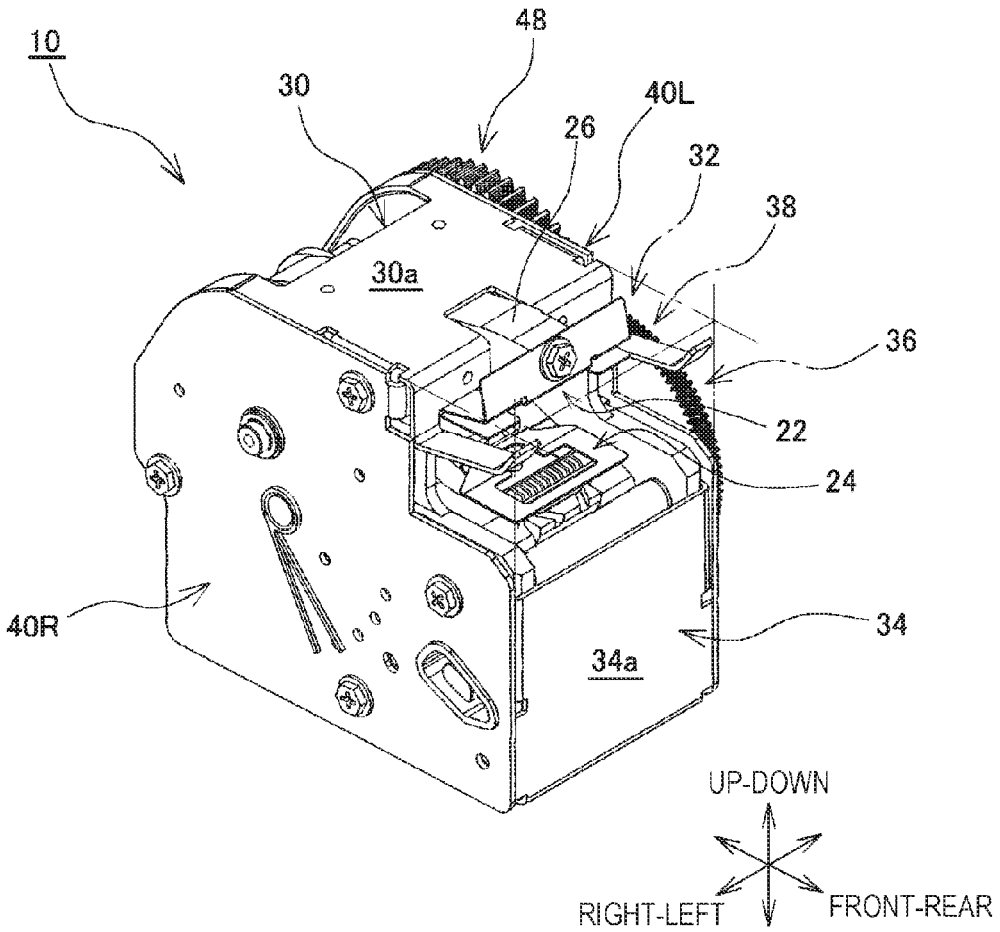
FIG. 2 is a perspective view illustrating an outward appearance of a recording-material binding device.

FIG. 2 is a perspective view illustrating an outward appearance of the recording-material binding device 10. The recording-material binding device 10 has an outer shape like a substantially rectangular parallelepiped. For plain explanation, front-rear, up-down, and right-left directions orthogonal to one another are determined in accordance with extending directions of sides of the rectangular parallelepiped. The up-down direction nearly coincides with a direction in which the upper tooth-shaped member 22 and the lower tooth-shaped member 24 are opposed to each other, and the front-rear direction nearly coincides with an extending direction of an upper arm 26 and a lower arm 28 (see FIG. 3) to which the upper tooth-shaped member 22 and the lower tooth-shaped member 24 are respectively attached. The upper tooth-shaped member 22 and the lower tooth-shaped member 24 are disposed in an upper front corner region 38 near a corner of the rectangular parallelepiped that defines the outer shape of the recording-material binding device 10 where a device upper surface 32 and a device front surface 36 intersect. The device upper surface 32 is defined by an upper surface plate 30*a* of an upper frame 30 of the rectangular parallelepiped, and the device front surface 36 is defined by a front surface plate 34*a* of a front frame 34 of the rectangular parallelepiped. In this upper front corner region 38, recording materials are clamped and bound by the upper and lower tooth-shaped members 22 and 24. Left and right sides of the recording-material binding device 10 are mostly covered with two side frames, namely, a left side frame 40L and a right side frame 40R.

Figure 3:
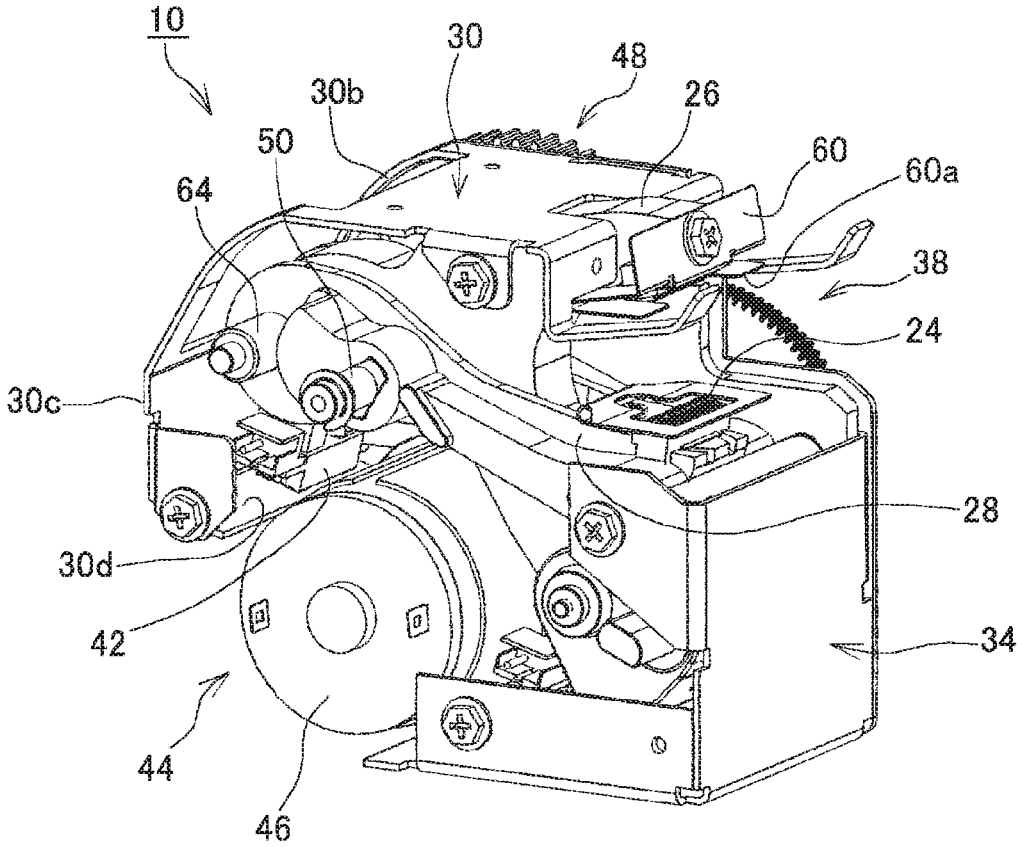
FIG. 3 is a perspective view illustrating an internal structure of the recording-material binding device.

FIG. 3 is a perspective view of the recording-material binding device 10 from which the right side frame 40R is removed so that the inside is seen. The upper frame 30 includes a rear surface plate 30*c* having an opening 30*b* and a support plate 30*d* extending frontward from a lower edge of the rear surface plate 30*c*. The rear surface plate 30*c* is curved at a portion where the opening 30*b* is provided. Thus, the outer shape of the recording-material binding device 10 is round-chamfered in an upper rear corner region. A home position sensor 42 is provided on the support plate 30*d* to detect the home position of a binding operation unit to be described later. Detection of the home position will be described in conjunction with the operation of the binding operation unit.

A motor 46 is disposed at a position diagonal to the upper front corner region 38, that is, in a lower rear corner region 44. The motor 46 has a motor pinion 46*a* (see FIG. 5) on an output shaft, and the motor pinion 46*a* is meshed with one gear in a gear train 48 disposed on an outer side of the left side frame 40L. The gear train 48 constitutes a reduction gear train, and the motor 46 rotates a cam shaft 50 through the gear train 48.

Figure 4:
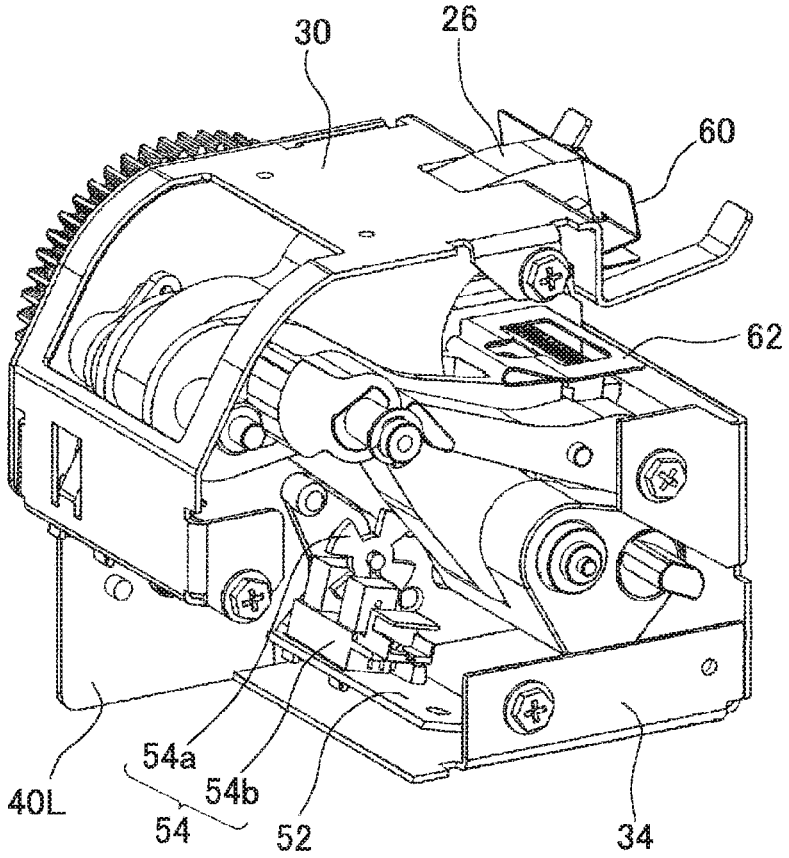
FIG. 4 is a perspective view illustrating the internal structure of the recording-material binding device.

FIG. 4 is a perspective view of the recording-material binding device 10 from which the motor 46 is also removed from the state of FIG. 3. An encoder bracket 52 is fixed to the left side frame 40L, and an encoder 54 for detecting the rotation angle of the motor 46 is disposed on the encoder bracket 52. The encoder 54 includes a rotor 54*a* rotatably supported by the encoder bracket 52, and a photosensor 54*b* fixed to the encoder bracket 52. The rotor 54*a* is shaped like an impeller having a rotation shaft, and an encoder pinion 54*c* is provided at an end of the rotation shaft. The encoder pinion 54*c* is meshed with one gear 48*a* in the gear train 48 (see FIG. 5). When the motor 46 rotates, the rotor 54*a* also rotates. The gear 48*a* with which the encoder pinion 54*c* is meshed may be a first stage gear of the gear train 48. The photosensor 54*b* has two opposed portions, and detects passage of blades of the rotor 54*a* between the opposed portions. By counting the number of passages of the blades, the rotation angle of the output shaft of the motor 46 is detected. The photosensor 54*b* may be replaced with a sensor of another type that detects the passage of the blades of the rotor 54*a*.

Figure 5:
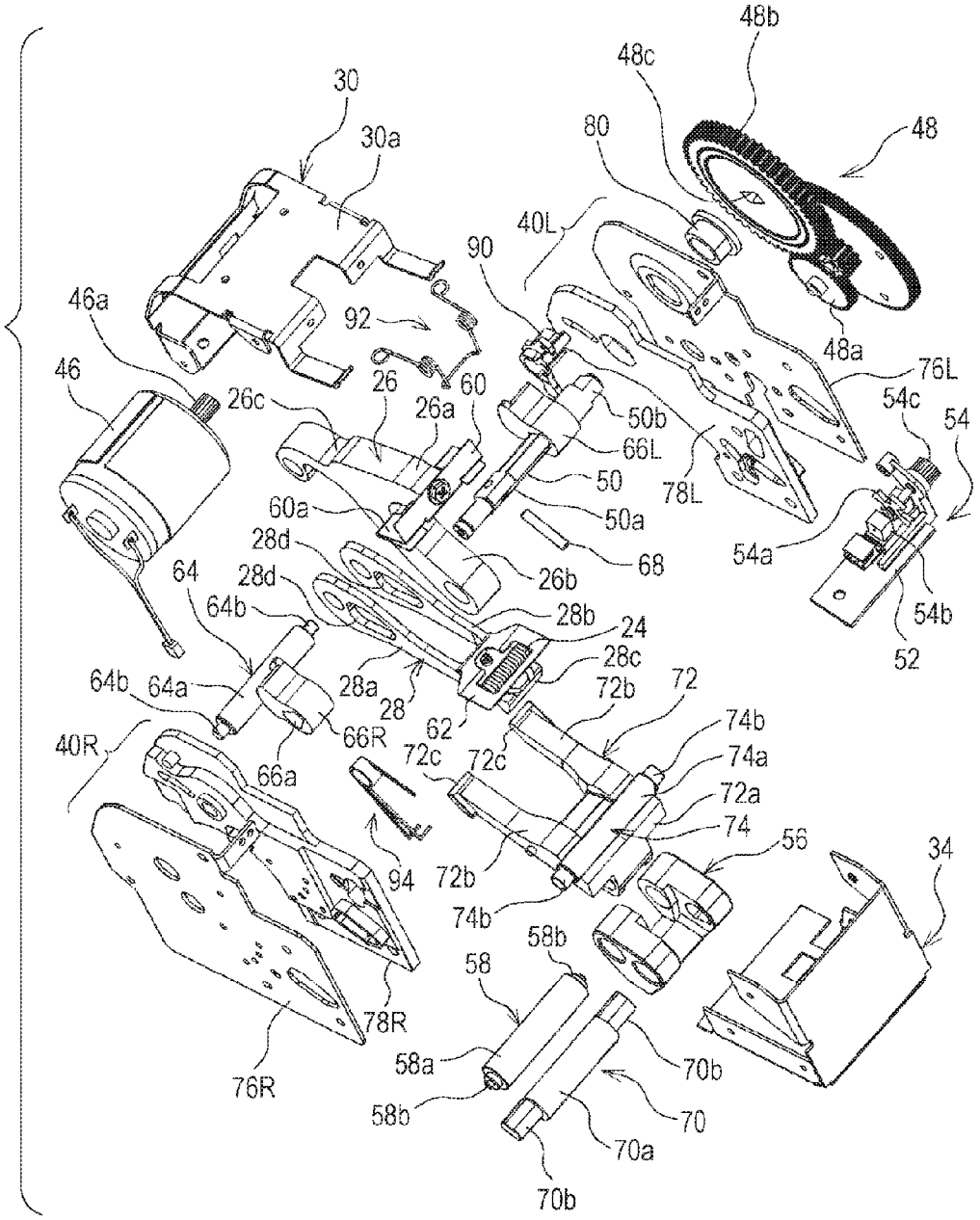
FIG. 5 is an exploded perspective view of the recording-material binding device.
Figure 6:
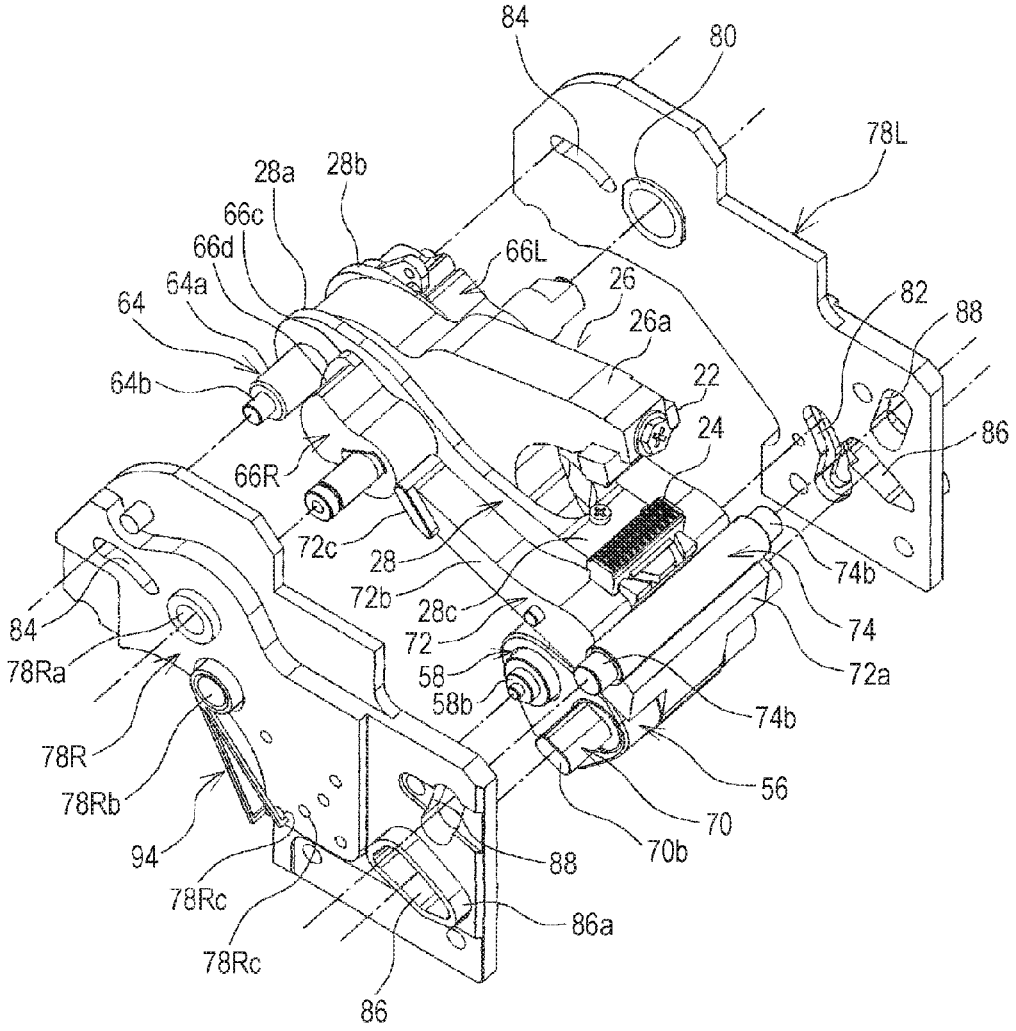
FIG. 6 is a perspective view illustrating a state in which a binding operation unit is separated from right and left side frames in the recording-material binding device.
Figure 7:
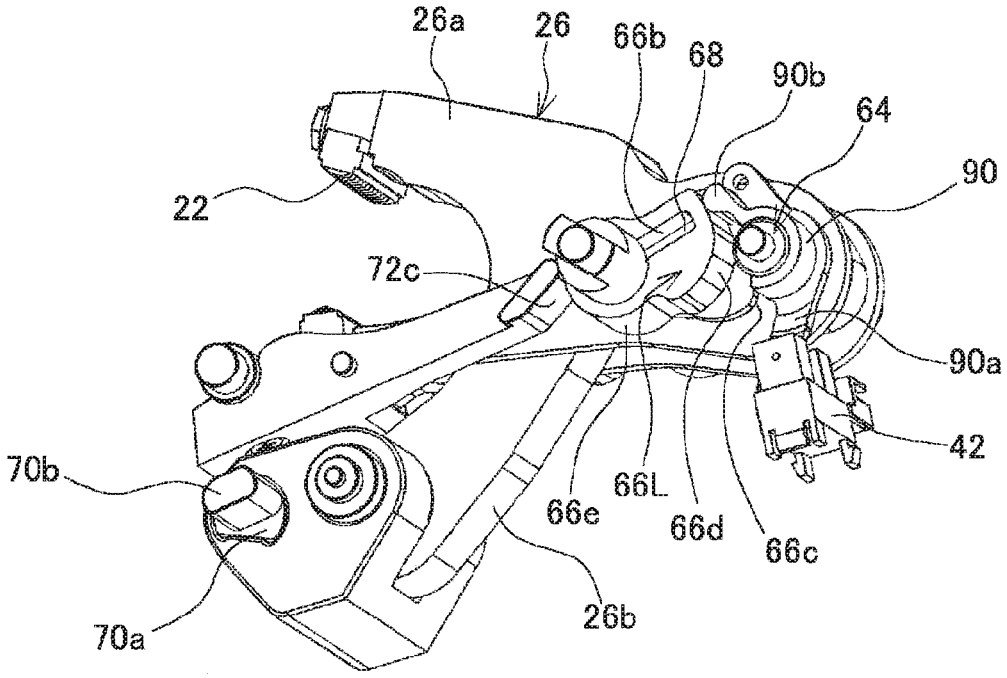
FIG. 7 is a perspective view of the binding operation unit in the recording-material binding device, when viewed from a different direction.

FIG. 5 is an exploded view of the recording-material binding device 10, and FIGS. 6 and 7 illustrate the principal part of the binding operation unit. The binding operation unit is constituted of the above-described upper and lower arms 26 and 28, a lever link 56 and a support lever 72 to be described later, and a connecting pin 58, an arm pin 64, and a guide pin 70 for coupling these elements.

The upper arm 26 includes an arm portion 26*a* extending in a substantially frontward direction and having a distal end portion to which the upper tooth-shaped member 22 is attached, and a connecting portion 26*b* branching from the arm portion 26*a* and extending downward to be coupled to a lever link 56. The connecting portion 26*b* and the lever link 56 are connected by a connecting pin 58 to be rotatable on the connecting pin 58. To a distal end portion of the upper arm 26, an upper guide plate 60 is attached to be located near the upper tooth-shaped member 22. Portions of the upper guide plate 60 located on the right and left of the upper tooth-shaped member 22 have V-shaped portions 60*a* formed by bending a steel plate, such as a spring steel plate, and opening frontward. The V-shaped portions 60*a* are closed when recording materials are bound, and the bound recording materials are separated from the upper tooth-shaped member 22 by an elastic opening force of the V-shaped portions 60*a*. The connecting pin 58 has a columnar shaft portion 58*a* and guide projections 58*b* projecting from both ends of the shaft portion 58*a*.

The lower arm 28 includes two arm plates 28*a* and 28*b* spaced from each other and extending frontward, and a distal end base 28*c* disposed at distal ends of the arm plates 28*a* and 28*b* to connect the arm plates 28*a* and 28*b*. The lower arm 28 may be integrally formed, or may be formed by assembling the two arm plates 28*a* and 28*b* and the distal end base 28*c* provided separately. The lower tooth-shaped member 24 is mounted on the distal end base 28*c*. A lower guide plate 62 is disposed to surround the lower tooth-shaped member 24. The lower guide plate 62 is V-shaped to open frontward by bending a steel plate such as a spring steel plate. When recording materials are bound, the V-shaped lower guide plate 62 is closed, and the bound recording materials are separated from the lower tooth-shaped member 24 by an elastic opening force of the V-shaped lower guide plate 62.

The upper arm 26 and the lower arm 28 are connected at rear ends thereof by an arm pin 64 to be independently rotatable. When connected, the upper arm 26 is located between the two arm plates 28*a* and 28*b* of the lower arm 28. The connecting portion 26*b* of the upper arm 26 passes between the arm plates 28*a* and 28*b* of the lower arm 28, and extends to a side opposite from the connecting portion 26*a* of the upper arm 26. When the upper arm 26 and the lower arm 28 turn on the arm pin 64, the upper tooth-shaped member 22 and the lower tooth-shaped member 24 move close to each other, and move away from each other. The arm pin 64 has a columnar shaft portion 64*a* and guide projections 64*b* projecting from both ends of the shaft portion 64*a*.

The two arm plates 28*a* and 28*b* of the lower arm 28 have their respective openings 28*d* through which the cam shaft 50 extends. To the cam shaft 50, two driving cams, that is, a left driving cam 66L and a right driving cam 66R are fixed to be located on the left and right sides of the upper arm 26 and the lower arm 28 when assembled. At two positions on the cam shaft 50, modified-section shaft portions 50*a* having a cross section other than a circular cross section, for example, a fan-shaped cross section from which a center portion is removed are provided. The left and right driving cams 66L and 66R have modified-section holes 66*a* that conform to this cross sectional shape. Fixing pins 68 stand on the modified-section shaft portions 50*a* of the cam shaft 50 in a direction intersecting the axis, or penetrate the modified-section shaft portions 50*a*. The left and right driving cams 66L and 66R have pin receiving grooves 66*b* for receiving the fixing pins 68 (see FIG. 7). The left and right driving cams 66L and 66R are fixed to the cam shaft 50 in the rotating direction by engaging with the modified-section shaft portions 50*a* and the fixing pins 68 of the cam shaft 50. The left and right driving cams 66L and 66R are more firmly fixed in the rotating direction by engaging not only with the modified-section shaft portions 50*a* but also with the fixing pins 68.

A fitting portion 50*b* having two parallel flat faces is provided at a left end of the cam shaft 50. The fitting portion 50*b* is fitted in one gear of the gear train 48, for example, a fitting hole 48*c* provided in the last stage gear 48*b* in the gear train 48. This fitting allows the cam shaft 50 to be rotated by the motor 46 through the gear train 48.

The lever link 56 is further coupled to a support lever 72 by a guide pin 70. The guide pin 70 has a shaft portion 70*a* and guide projections 70*b* extending from both ends of the shaft portion 70*a*. The shaft portion 70*a* has a noncircular cross-sectional shape, for example, a noncircular cross-sectional shape defined by one chord of a circle and a larger one of arcs divided by this chord, as illustrated in FIG. 7. Holes of the lever link 56 for receiving the guide pin 70 have such a shape as to fit the shaft portion 70*a* of the guide pin 70. Thus, the guide pin 70 is fixed to the lever link 56 in the rotating direction.

When recording materials are bound, the support lever 72 supports the distal end base 28*c* of the lower arm 28 from below, and receives a reaction force of the binding operation. The support lever 72 includes a support 72*a* located below the distal end base 28*c* of the lower arm 28 when the recording materials are bound, and two lever portions 72*b* extending rearward from the support 72*a* outside the lower arm 28. The support lever 72 may be integrally formed, or may be formed by connecting the support 72*a* and the two lever portions 72*b* separately formed. A support bar 74 is fixed on the support 72*a*. The support bar 74 has a columnar shaft portion 74*a* and guide projections 74*b* projecting from both ends of the shaft portion 74*a*. At rear ends of the two lever portions 72*b*, cam followers 72*c* are provided to be in contact with the left and right driving cams 66L and 66R.

The left side frame 40L has a left side panel 76L and a left guide plate 78L. When assembled, the left side panel 76L and the left guide plate 78L are superposed into one. The right side frame 40R has a right side panel 76R and a right guide plate 78R. When assembled, the right side panel 76R and the right guide plate 78R are superposed into one.

The cam shaft 50 is rotatably supported by the left and right side frames 40L and 40R by being passed through a bearing bush 80 attached to the left side frame 40L and a bearing hole 78Ra provided in the right guide plate 78R.

The left and right guide plates 78L and 78R respectively have guide grooves 82, 84, and 88 and guide holes 86 for guiding movements of the connecting pin 58, the arm pin 64, the guide pin 70, and the support bar 74.

The guide projections 58*b* provided at both ends of the connecting pin 58 are fitted in left and right connecting-pin guide grooves 82. The guide projections 58*b* have a stepped columnar shape. Correspondingly thereto, the connecting-pin guide grooves 82 have such a stepped groove shape as to be deep in a center portion thereof and to be shallow near an edge thereof. The connecting-pin guide grooves 82 have their respective bottoms, and are not open to outer surfaces of the left and right guide plates 78L and 78R. The connecting-pin guide grooves 82 are bent, but extend in a substantially up-down direction.

The guide projections 64*b* provided at both ends of the arm pin 64 are fitted in arm-pin guide grooves 84. The arm-pin guide grooves 84 extend in a substantially front-rear direction, and guide frontward and rearward movements of the upper arm 26 and the lower arm 28. The arm-pin guide grooves 84 extend through the entire thickness of the left and right guide plates 78L and 78R.

The guide projections 70*b* provided at both ends of the guide pin 70 are put in guide holes 86. The guide projections 70*b* have a modified cross-sectional shape nearly like an oval. The cross-sectional shape of the guide holes 86 is substantially trapezoidal, and the guide holes 86 are larger than the guide projections 70*b* as a whole. For this reason, upward, downward, frontward, and rearward movements of the guide projections 70*b* are permitted within the guide holes 86. The dimension of the guide holes 86 in the right-left direction is extended by extension walls 86*a* standing on the outer side surfaces of the left and right guide plates 78L and 78R.

At both ends of the support bar 74 provided integrally with the support lever 72, the columnar guide projections 74*b* are provided, and are fitted in support-lever guide grooves 88. The support-lever guide grooves 88 extend in a substantially up-down direction, and guide the movement of the support lever 72, particularly, the support 72*a* in the up-down direction. The support-lever guide grooves 88 extend through the entire thickness of the left and right guide plates 78L and 78R.

The left and right driving cams 66L and 66R respectively have first cam faces 66*c* in contact with the arm pin 64 and second cam faces 66*d* in contact with the cam followers 72*c* provided in the support lever 72 (see FIGS. 6 and 7). The first cam faces 66*c* and the second cam faces 66*d* project from cam base bottom faces 66*e* constituted by parts of cylindrical surfaces having an axis common to the cam shaft 50. The first cam faces 66*c* project more than the second cam faces 66*d*.

As illustrated in FIG. 7, a home-position detector 90 is attached to a left end portion of the arm pin 64 to be turnable on the arm pin 64. The home-position detector 90 has a detection piece 90*a* serving as a detection object for the home position sensor 42 and a cam follower 90*b* in contact with the second cam face 66*d* of the left driving cam 66L. As the left driving cam 66L turns, the home-position detector 90 pivots, and the detection piece 90*a* advances or retreats relative to the home position sensor 42. A photosensor may be used as the home position sensor 42. When the detection piece 90*a* is put between two portions of the home position sensor 42, the home position of the binding operation unit is detected.

Figure 8:
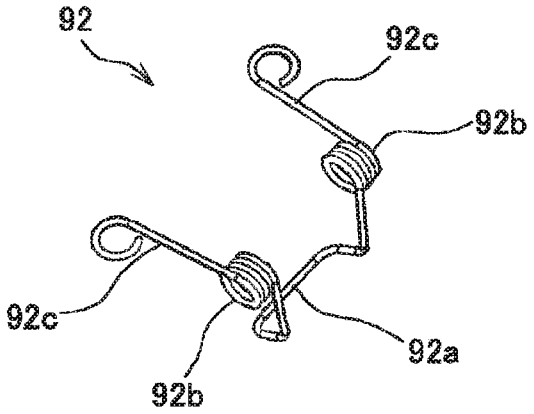
FIG. 8 is a perspective view of a push-out spring.

FIG. 8 illustrates a push-out spring 92. The push-out spring 92 abuts on the upper arm 26, and biases the entire binding operation unit to the lower front side. The push-out spring 92 has an operating portion 92*a* to abut on a spring receiving face 26*c* (see FIG. 5) provided on a slightly rear side of an upper part of the upper arm 26. The operating portion 92*a* has a substantially U-shape, and fixed portions 92*c* are connected to the operating portion 92*a* with coil portions 92*b* at both ends being interposed therebetween. The fixed portions 92*c* are fixed to an inner surface of the upper surface plate 30*a* of the upper frame 30, and the operating portion 92*a* is turnable on the coil portions 92*b*. The push-out spring 92 biases the entire binding operation unit to push out the binding operation unit to the lower front side.

Figure 9:
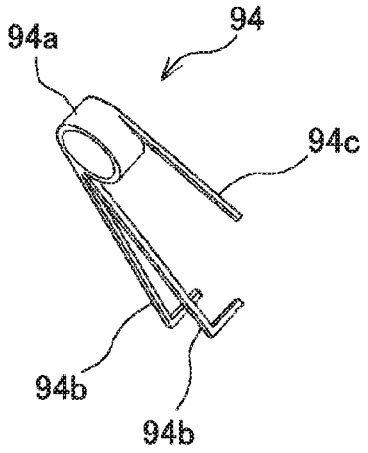
FIG. 9 is a perspective view of a support spring.

FIG. 9 illustrates a support spring 94. The support spring 94 supports the support lever 72 so that the positions of the cam followers 72*c* of the support lever 72 are not excessively lowered when the support lever 72 is separate from the driving cams 66L and 66R. Since the support spring 94 supports the support lever 72, when the driving cams 66L and 66R turn, the second cam faces 66*d* are brought into contact with the cam followers 72*c*. A cylindrical coil portion 94*a* of the support spring 94 is attached to a boss 78Rb of the right guide plate 78R (see FIG. 6). Bent distal ends of fixed arms 94*b* extending from the coil portion 94*a* are engaged with engaging holes 78Rc provided in an outer side surface of the right guide plate 78R, and the support spring 94 is thereby fixed in the rotating direction. A support arm 94*c* of the support spring 94 extends from the coil portion 94*a* along an inner surface of the right guide plate 78R. A distal end of the support arm 94*c* supports a lower surface of one of the lever portions 72*b* in the support lever 72. The support arm 94*c* may be separate from the support lever 72 when the driving cams 66L and 66R are in contact with the support lever 72.

FIGS. 10 to 13 are operation explanatory views of the binding operation unit in the recording-material binding device 10. The binding operation unit operates to bind recording materials by using the driving cams 66. In the description of the operation, when the left and right driving cams 66L and 66R do not need to be distinguished, they are simply referred to as driving cams 66 for simplicity. For the connecting-pin guide grooves 82, only the deep portions in the stepped grooves are illustrated for simplicity.

Figure 10:
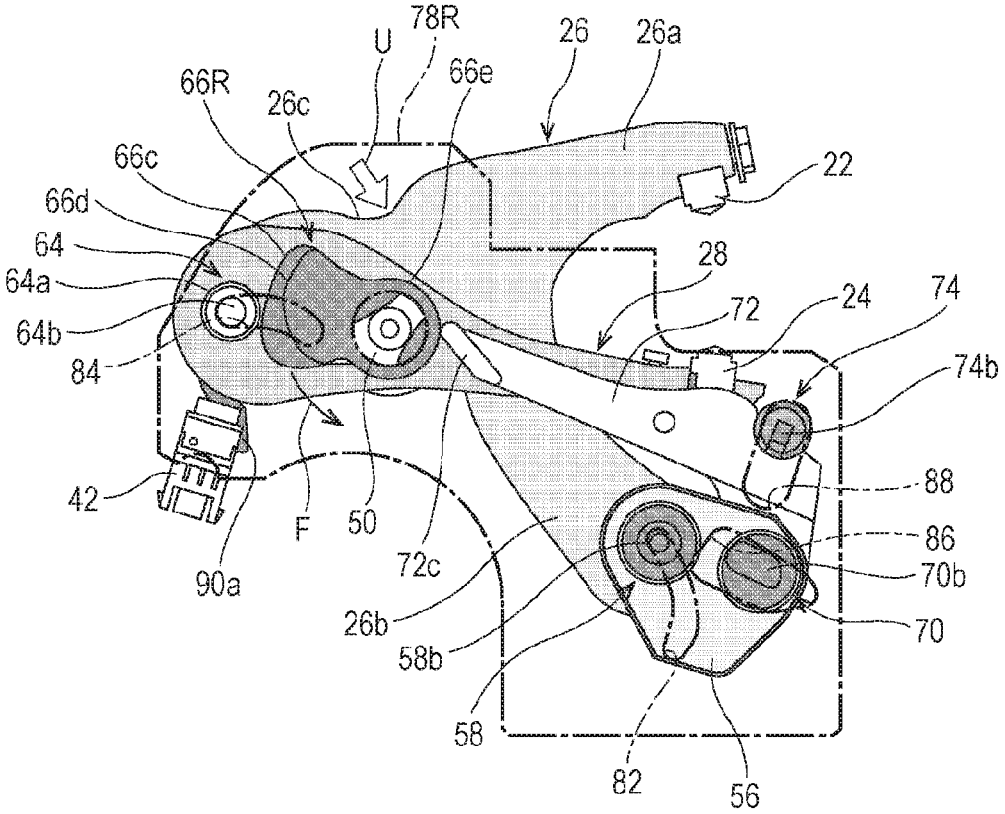
FIG. 10 is an explanatory view of a binding operation, and illustrates a home position of the binding operation unit.

FIG. 10 illustrates a state in which the binding operation unit is at a home position. At the home position, the first cam faces 66*c* of the driving cams 66 are in contact with the shaft portion 64*a* of the arm pin 64. Thus, the first cam faces 66*c* maximally retreat the arm pin 64, and the entire binding operation unit is retreated. The upper tooth-shaped member 22 and the lower tooth-shaped member 24 are also retreated, and are most separate from each other. The connecting portion 26*b* of the upper arm 26 is pulled up until the guide projections 58*b* of the connecting pin 58 are located near upper ends of the connecting-pin guide grooves 82. Correspondingly to this position of the connecting pin 58, the guide projections 70*b* of the guide pin 70 are located at the centers of upper sides of the guide holes 86, and the guide projections 74*b* of the support bar 74 are located near upper ends of the support-lever guide groove 88. At this time, as illustrated in FIG. 7, the cam follower 90*b* of the home-position detector 90 abuts on the second cam face 66*d*, and the detection piece 90*a* is located at a detection object position of the home position sensor 42. On the basis of detection of the home position sensor 42 for the detection piece 90*a*, the controller 25 recognizes that the binding operation unit is at the home position.

When the driving cams 66 turn from the home position in a counterclockwise direction F in FIG. 10, the shaft portion 64*a* of the arm pin 64 separates from the first cam faces 66*c* at a certain position, and is brought into contact with the cam base bottom faces 66*e*.

Figure 11:
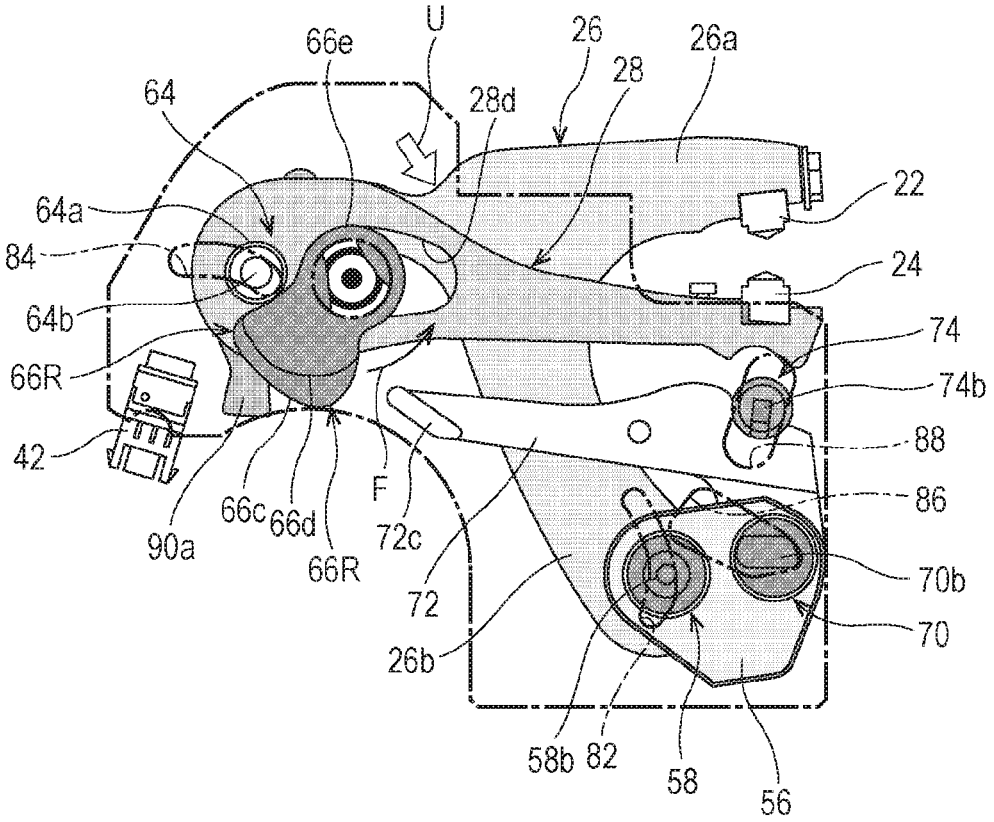
FIG. 11 is an explanatory view of the binding operation, and illustrates a state in which upper and lower tooth-shaped members are slightly closed.

FIG. 11 illustrates a state immediately after the shaft portion 64*a* of the arm pin 64 separates from the first cam faces 66*c*. Since the shaft portion 64*a* and the first cam faces 66*c* are disengaged from each other, the binding operation unit is entirely pushed out to the lower front side (lower right side in FIG. 11) by a biasing force U of the push-out spring 92. The arm pin 64 moves frontward along the arm-pin guide grooves 84, and the upper arm 26 moves frontward along therewith. At the same time, the upper arm 26 also moves downward as the guide projections 58*b* of the connecting pin 58 at the lower end of the connecting portion 26*b* are guided downward along the connecting-pin guide grooves 82. For this reason, the upper tooth-shaped member 22 advances frontward, and also moves downward. The lower arm 28 moves frontward along the frontward movement of the arm pin 64. Also, the lower arm 28 is guided by the cam shaft 50 penetrating the openings 28*d*, and moves almost frontward without turning. For this reason, the lower tooth-shaped member 24 also advances frontward. Since the upper tooth-shaped member 22 advances to the lower front side and the lower tooth-shaped member 24 advances frontward, the upper and lower tooth-shaped members 22 and 24 approach each other while advancing frontward.

Since upper parts of the connecting-pin guide grooves 82 obliquely extend to the lower front side, the lever link 56 moves to the lower front side along with the movement of the connecting pin 58 along the connecting-pin guide grooves 82. However, when the guide projections 70*b* of the guide pin 70 come into contact with front edges of the guide holes 86, the lever link 56 does not further move frontward, but turns on the guide pin 70 in the counterclockwise direction. As the guide pin 70 moves to the lower front side, the support lever 72 also moves. Since the support bar 74 provided integrally with the support lever 72 moves along the support-lever guide grooves 88 that extend in a substantially up-down direction, the support bar 74 does not move frontward even when the guide pin 70 moves frontward. As illustrated in FIG. 11, the support-lever guide grooves 88 extend rearward as they extend downward. For this reason, the support lever 72 is turned in the counterclockwise direction. Thus, the cam followers 72*c* at the rear end of the support lever 72 move downward. At this time, the support spring 94 supports a rear portion of the support lever 72 from below so that the cam followers 72*c* do not excessively move.

The home-position detector 90 moves frontward together with the arm pin 64, and the detection piece 90*a* comes out of the detection object position of the home position sensor 42.

Figure 12:
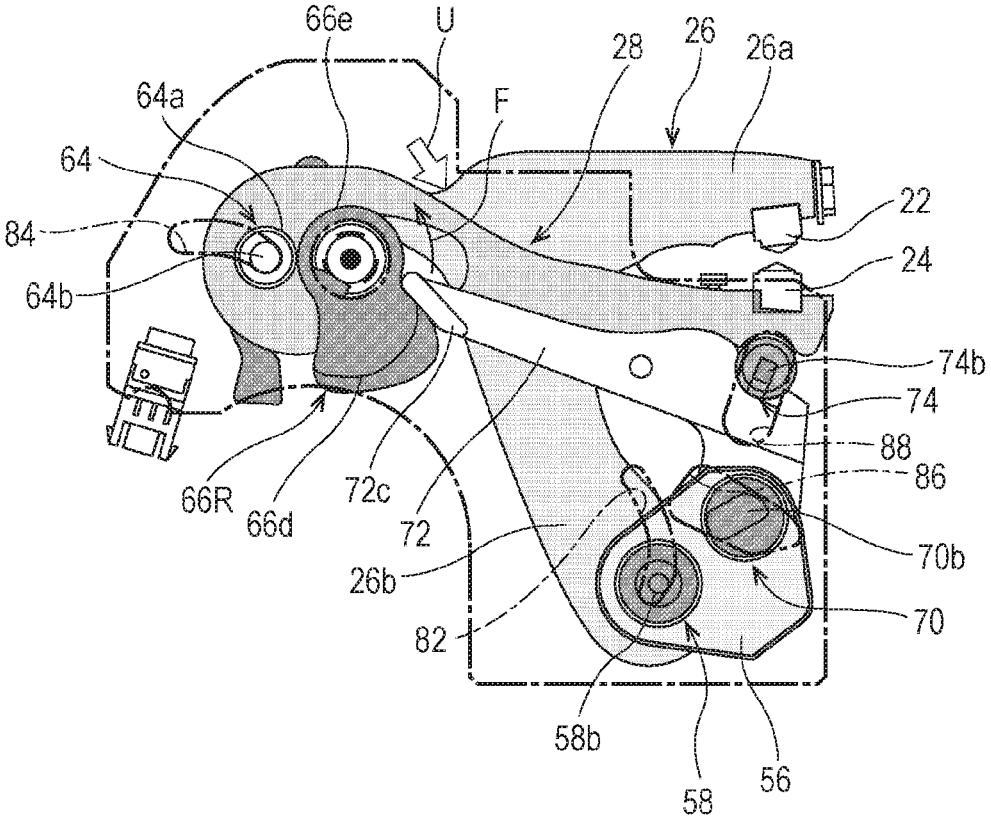
FIG. 12 is an explanatory view of the binding operation, and illustrates a state immediately before the upper and lower tooth-shaped members bite each other.

FIG. 12 illustrates a state in which the driving cams 66 are further turned in the counterclockwise direction F and the second cam faces 66*d* are in contact with the cam followers 72*c* of the support lever 72. The arm pin 64 is in contact with the cam base bottom faces 66*e* of the driving cams 66, and is located at a position further shifted frontward from the position of FIG. 11. Thus, the upper arm 26 also further moves to the lower front side from the state of FIG. 11, and the lower arm 28 further moves frontward. Along with the downward movement of the connecting portion 26*b* of the upper arm 26, the guide projections 58*b* of the connecting pin 58 are guided along the connecting-pin guide grooves 82. The connecting-pin guide grooves 82 are bent, and portions on a lower side of bent points extend rearward as they extend downward. Since the lower portions of the connecting-pin guide grooves 82 extend rearward, the upper arm 26 turns clockwise. The lever link 56 is pulled downward by the connecting pin 58, and turns counterclockwise because the downward movement of the guide projections 70*b* of the guide pin 70 is restricted by the guide holes 86. By the movement of the connecting pin 58 to the rear lower side and the counterclockwise turn of the lever link 56, the guide projections 70*b* of the guide pin 70 are moved to the center portions of the guide holes 86. At the same time, the guide projections 74*b* of the support bar 74 move upward along the support-lever guide grooves 88, and the support lever 72 moves upward. Since the rearward movement of the guide projections 74*b* of the support bar 74 is restricted by the support-lever guide grooves 88, when the guide pin 70 moves rearward, the support lever 72 turns on the support bar 74 in the clockwise direction. Along with the clockwise turn of the support lever 72, the cam followers 72*c* move up to a position where the second cam faces 66*d* of the driving cams 66 abut on the cam followers 72*c*. This upward movement of the cam followers 72*c* is assisted by the support spring 94. When the second cam faces 66*d* of the driving cams 66 come into contact with the cam followers 72*c* of the support lever 72, the support lever 72 is turned clockwise by further turn of the driving cams 66. Also, the support bar 74 comes into contact with the lower surface of the lower arm 28.

Figure 13:
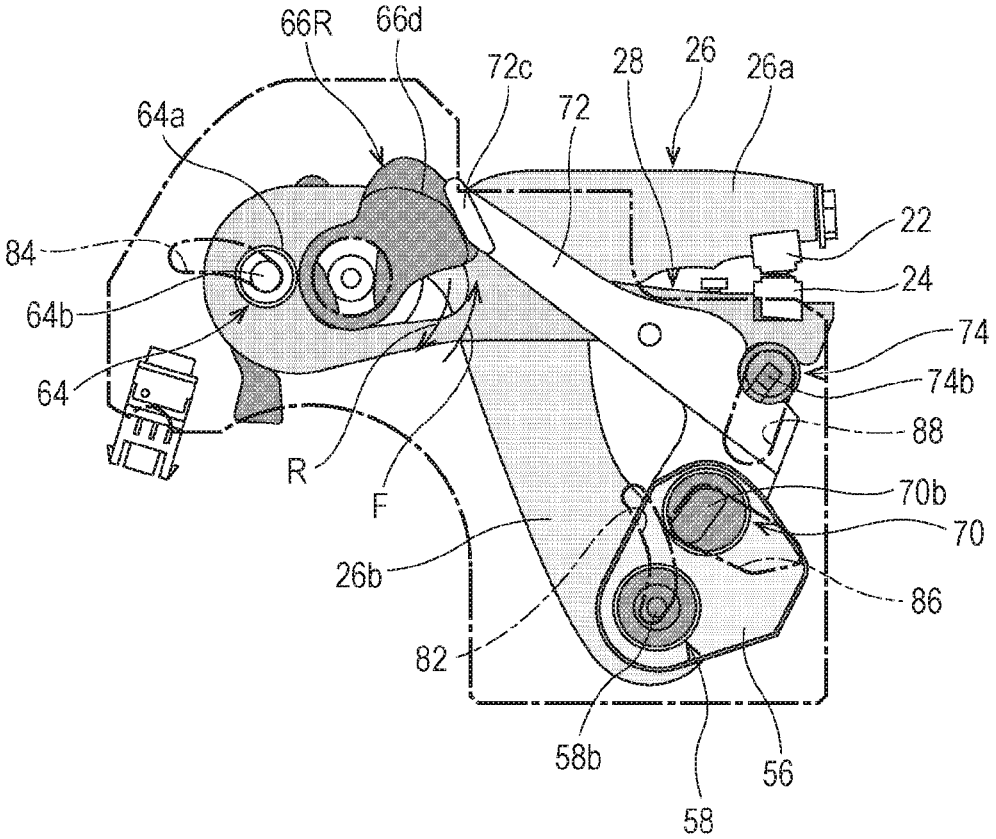
FIG. 13 is an explanatory view of the binding operation, and illustrates a state in which the upper and lower tooth-shaped members have bitten each other.

FIG. 13 illustrates a state in which the driving cams 66 are further turned counterclockwise and recording materials are clamped by the upper tooth-shaped member 22 and the lower tooth-shaped member 24. The cam followers 72*c* of the support lever 72 are further pushed upward from the state of FIG. 12 by the second cam faces 66*d*. On the other hand, the guide projections 74*b* of the support bar 74 reach the upper ends of the support-lever guide grooves 88, and the support lever 72 turns on the support bar 74 in the clockwise direction. Along with the turn of the support lever 72, the guide projections 70*b* of the guide pin 70 move to the rear ends of the guide holes 86, and the lever link 56 further turns counterclockwise. Through these operations, the connecting pin 58, the guide pin 70, and the support bar 74 are aligned nearly on a straight line. Also, the support bar 74 pushes up the lower arm 28, and the upper tooth-shaped member 22 and the lower tooth-shaped member 24 bite each other.

When the upper tooth-shaped member 22 and the lower tooth-shaped member 24 bite, recording materials clamped by the upper tooth-shaped member 22 and the lower tooth-shaped member 24 are deformed in a wavy form, and the recording materials are joined and bound. The second cam faces 66*d* of the driving cams 66 are shaped to gradually push up the cam followers 72*c* as they turn. When the stack of recording materials is thin, it is required that the upper and lower tooth-shaped members 22 and 24 should bite deeper than when the stack is thick. Hence, the driving cams 66 are turned more. Information about the thickness of the recording materials is input to the controller 25, for example, by the user of the image forming system 11. On the basis of this information, the turn angle of the driving cams 66, that is, the rotation angle of the motor 46 is determined. The rotation angle of the motor 46 from the home position is detected by the encoder 54. When the rotation angle reaches a rotation angle corresponding to the thickness of the recording materials at this time, the rotation of the motor 46 is stopped.

After that, the motor 46 reverses, and the driving cams 66 turn in reverse in the clockwise direction R. When the driving cams 66 turn in reverse and reach, for example, the position of FIG. 12, the upper tooth-shaped member 22 and the lower tooth-shaped member 24 separate from each other. By the action of the upper guide plate 60 and the lower guide plate 62 disposed around the upper and lower tooth-shaped members 22 and 24, the bundle of recording materials is pulled away from the upper tooth-shaped member 22 or the lower tooth-shaped member 24. When the driving cams 66 further turn in reverse and the first cam faces 66*c* come into contact with the shaft portion 64*a* of the arm pin 64, the arm pin 64 is moved rearward along the arm-pin guide grooves 84. With this, the binding operation unit is entirely moved to the upper rear side. When the binding operation unit returns to the position of FIG. 10 and the home position is detected by the home position sensor 42, the rotation of the motor 46 is stopped.

Figure 14:
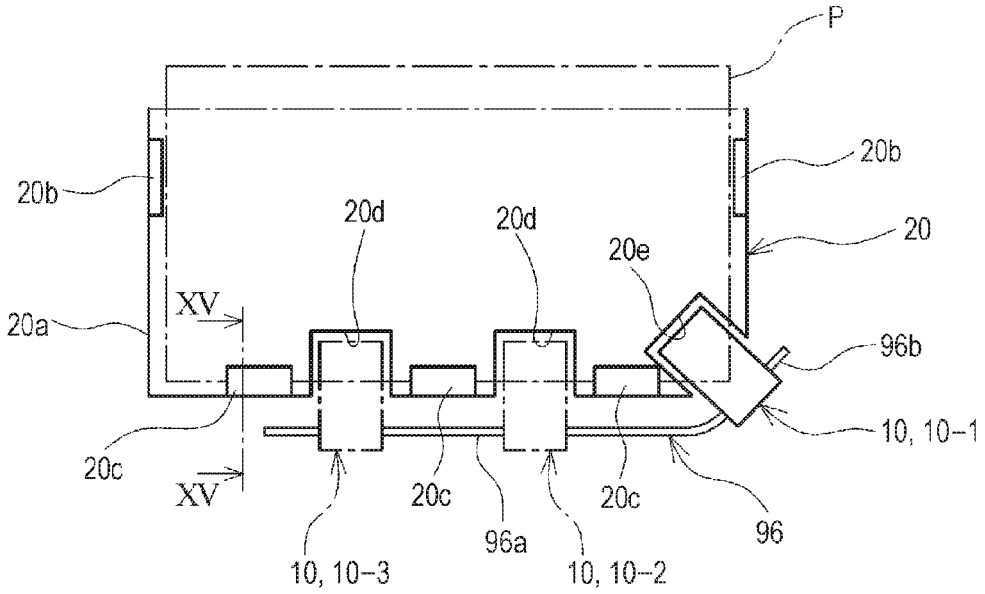
FIG. 14 illustrates the positional relationship between an accumulation tray and the recording-material binding device.
Figure 15:
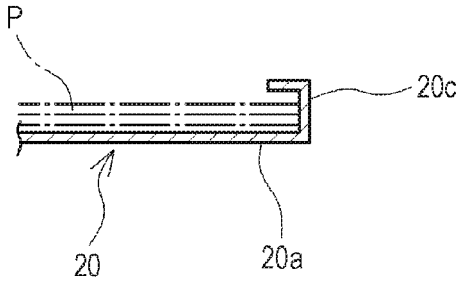
FIG. 15 illustrates a cross-sectional shape of a distal end wall of the accumulation tray.

FIG. 14 illustrates the positional relationship between the accumulation tray 20 and the recording-material binding device 10. FIG. 15 is an end face view taken along line XV-XV in FIG. 14. The accumulation tray 20 includes a bottom plate 20*a* on which recording materials P are placed, and side walls 20*b* standing on the bottom plate 20*a* to regulate the positions of both side edges of the recording materials P. Further, distal end walls 20*c* stand on the bottom plate 20*a* so that distal ends of transported recording materials abut on the distal end walls 20*c*. As illustrated in FIG. 15, the distal end walls 20*c* have bent upper ends, and are shaped like an inverse L. The distal ends of the recording materials P are placed and positioned inside the L-shaped portions.

A side of the bottom plate 20*a* where the distal end walls 20*c* are provided (hereinafter referred to as a distal end side) has cutouts 20*d* at two positions. The cutouts 20*d* extend from the distal end side in a direction orthogonal to the distal end side. A cutout 20*e* is provided in one corner portion of the distal end side of the bottom plate 20*a*. The cutout 20*e* extends in a direction at an angle to the distal end side. This direction is at an angle of, for example, 45° to the distal end side. The distal end walls 20*c* are provided at such positions as not to interfere with the cutouts 20*d* and 20*e*.

The recording-material binding device 10 is moved along a rail 96 by an unillustrated driving mechanism. The rail 96 includes a side portion 96*a* along the distal end side of the bottom plate 20*a* and a corner portion 96*b* bent from one end of the side portion 96*a* and corresponding to the corner portion of the bottom plate 20*a*. When recording materials P are bound at the corner portion, the recording-material binding device 10 is moved to a position 10-1 in FIG. 14, that is, a position corresponding to the cutout 20*e*. When the recording materials P are bound at the position of the cutout 20*e*, the bottom plate 20*a* does not hinder the binding operation of the recording-material binding device 10. When recording materials P are bound at two positions along the side thereof, the recording-material binding device 10 is moved to a position 10-2 in FIG. 14 corresponding to one of the cutouts 20*d*, where the recording materials P are bound. Next, the recording-material binding device 10 is moved to a position 10-3 corresponding to the other cutout 20*d*, and the recording materials P are bound at this position.

A cutout may be provided at a corner opposite from the corner where the cutout 20*e* is provided, and the rail 96 may be extended so that the recording materials P are also bound at this corner. Alternatively, cutouts may be provided at three or more positions along the side so that the recording materials are bound at the three or more positions.

Figure 16:
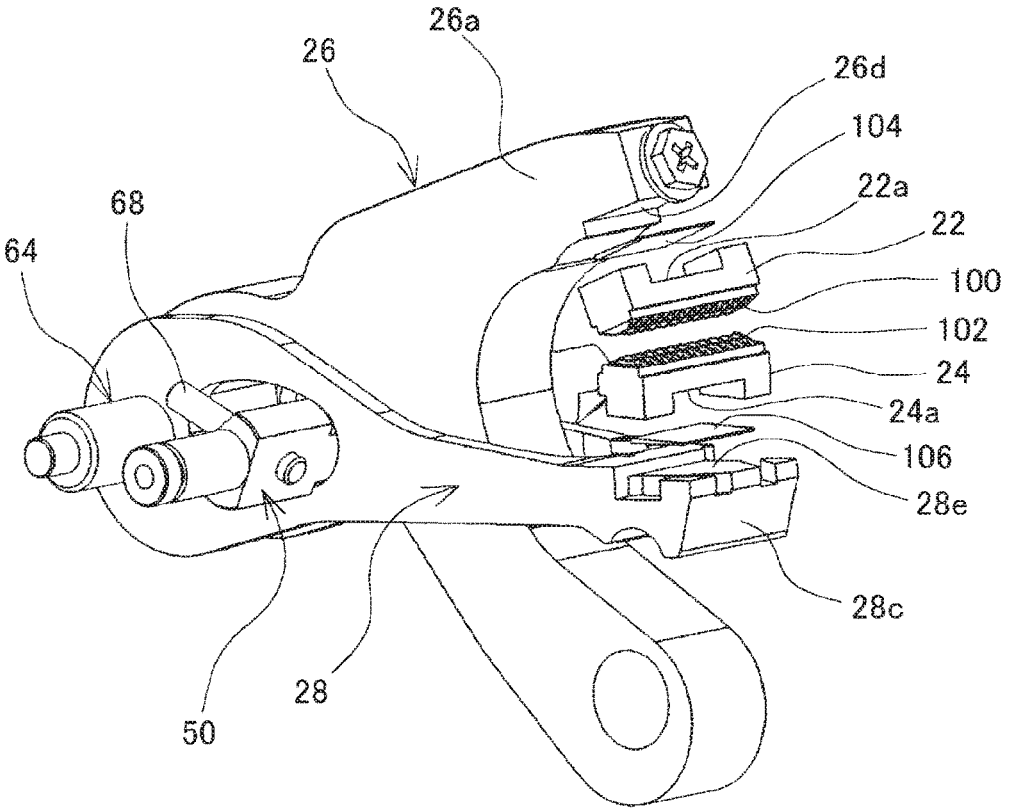
FIG. 16 is an exploded view illustrating a state in which the upper tooth-shaped member and the lower tooth-shaped member are removed from an upper arm and a lower arm.

FIG. 16 is a perspective view illustrating a state in which the upper tooth-shaped member 22 and the lower tooth-shaped member 24 are removed from the upper arm 26 and the lower arm 28, respectively. The upper tooth-shaped member 22 has plural teeth 100 arranged in the right-left direction of the recording-material binding device 10 when attached to the upper arm 26. Similarly, the lower tooth-shaped member 24 has plural teeth 102 arranged in the right-left direction of the recording-material binding device 10 when attached to the lower arm 28. A direction in which the teeth are arranged is referred to as "tooth arrangement direction." A direction along the width of each tooth is referred to as "tooth width direction", and a direction along the height of each tooth is referred to as "tooth height direction." Further, the teeth 100 of the upper tooth-shaped member 22 are referred to as "upper teeth 100", and the teeth 102 of the lower tooth-shaped member 24 are referred to as "lower teeth 102."

The upper tooth-shaped member 22 is attached to a pedestal 26*d* of the upper arm 26 with a wedge-shaped upper shim 104 interposed therebetween. The upper tooth-shaped member 22 is U-shaped to open upward. The upper tooth-shaped member 22 is positioned in the right-left direction with vertical portions of the U-shape being engaged with right and left side surfaces of the pedestal 26*d* provided at a distal end of the upper arm 26. A bottom surface 22*a* of the upper tooth-shaped member 22 corresponding to a horizontal portion of the U-shape is in tight contact with the upper shim 104. The upper tooth-shaped member 22 is attached to a surface of the upper shim 104 opposed to the upper tooth-shaped member 22. The lower tooth-shaped member 24 is attached to a pedestal 28*e* of the lower arm 28 with a wedge-shaped lower shim 106 interposed therebetween. The lower tooth-shaped member 24 is U-shaped to open downward. The lower tooth-shaped member 24 is positioned in the right-left direction with vertical portions of the U-shape being engaged with right and left side surfaces of the pedestal 28*e* provided on the distal end base 28*c* of the lower arm 28. A bottom surface 24*a* of the lower tooth-shaped member 24 corresponding to a horizontal portion of the U-shape is in tight contact with the lower shim 106. The lower tooth-shaped member 24 is attached to a surface of the lower shim 106 opposed to the lower tooth-shaped member 24. The tooth arrangement direction of the upper tooth-shaped member 22 and the lower tooth-shaped member 24 may coincide with the axial direction of the arm pin 64.

Figure 17:
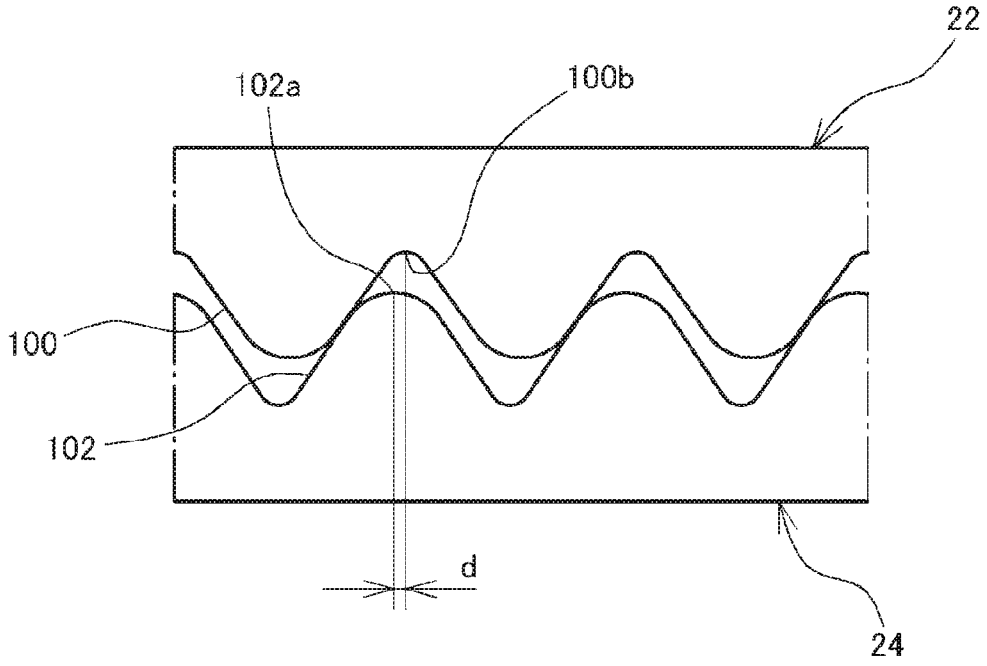
FIG. 17 illustrates the bite of the upper tooth-shaped member and the lower tooth-shaped member.

FIG. 17 illustrates a state in which the upper tooth-shaped member 22 and the lower tooth-shaped member 24 bite each other, when viewed from the tooth width direction. In particular, FIG. 17 illustrates a state in which the upper tooth-shaped member 22 and the lower tooth-shaped member 24 are displaced from each other in the tooth arrangement direction. As illustrated in FIG. 17, tooth bottoms 100*b* of the tooth row of the upper teeth 100 and tooth tips 102*a* of the lower teeth 102 are displaced from each other by a dimension d. If the upper teeth 100 and the lower teeth 102 are thus displaced, one tooth surface of one tooth is in strong contact with a tooth on the other side, and the other tooth surface is in weak contact with the tooth on the other side. If recording materials are clamped in such an uneven contact state, the recording materials are sometimes damaged by the tooth surface in strong contact, and the recording materials are sometimes not sufficiently joined on the weak contact side. In the recording-material binding device 10, the upper tooth-shaped member 22 and the lower tooth-shaped member 24 are arranged to tilt relative to each other, when viewed from the tooth arrangement direction. The surfaces to which the upper tooth-shaped member 22 and the lower tooth-shaped member 24 are attached are made inclined surfaces by the upper shim 104 and the lower shim 106. Thus, the upper tooth-shaped member 22 and the lower tooth-shaped member 24 are tilted.

Figure 18:
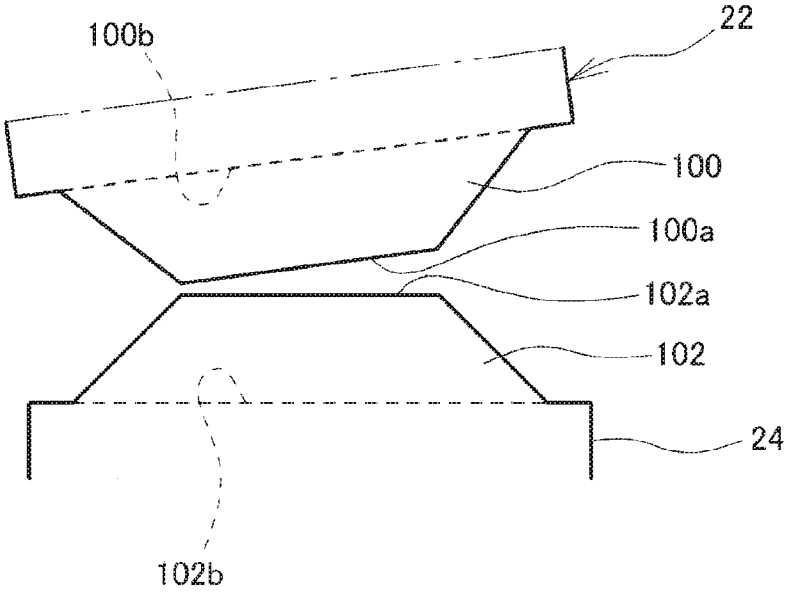
FIG. 18 illustrates the positional relationship between a tooth of the upper tooth-shaped member and a tooth of the lower tooth-shaped member.

FIG. 18 illustrates a state of an upper tooth 100 and a lower tooth 102 immediately before they bite each other, when viewed from the tooth arrangement direction. In the upper tooth 100, a tooth tip 100*a* and a tooth bottom 100*b* are parallel to each other, and the tooth height is constant within the width of the tooth tip 100*a*. The tooth tip 100*a* of the upper tooth 100 is also parallel to the bottom surface 22*a* of the upper tooth-shaped member 22. In the lower tooth 102, a tooth tip 102*a* and a tooth bottom 102*b* are parallel to each other, and the tooth height is constant within the width of the tooth tip 102*a*. The tooth tip 102*a* of the lower tooth 102 is also parallel to the bottom surface 24*a* of the lower tooth-shaped member 24. As illustrated in FIG. 18, the tooth tip 100*a* of the upper tooth 100 is tilted relative to the tooth tip 102*a* of the lower tooth 102, and starts biting from one end thereof, that is, a left end in FIG. 18. That is, the left end of the tooth tip 100*a* of the upper tooth 100 reaches a plane defined by the tooth tip 102*a* of the lower tooth 102. This time is a biting start time. If biting starts in a state in which the upper tooth 100 and the lower tooth 102 are displaced from each other in the tooth arrangement direction, the upper tooth 100 and the lower tooth 102 move to remove the displacement at the left end where biting first starts. That is, in FIG. 17, the upper teeth 100 move to the left, and the lower teeth 102 move to the right. This movement removes displacement in portions that start biting subsequently.

Figure 19:
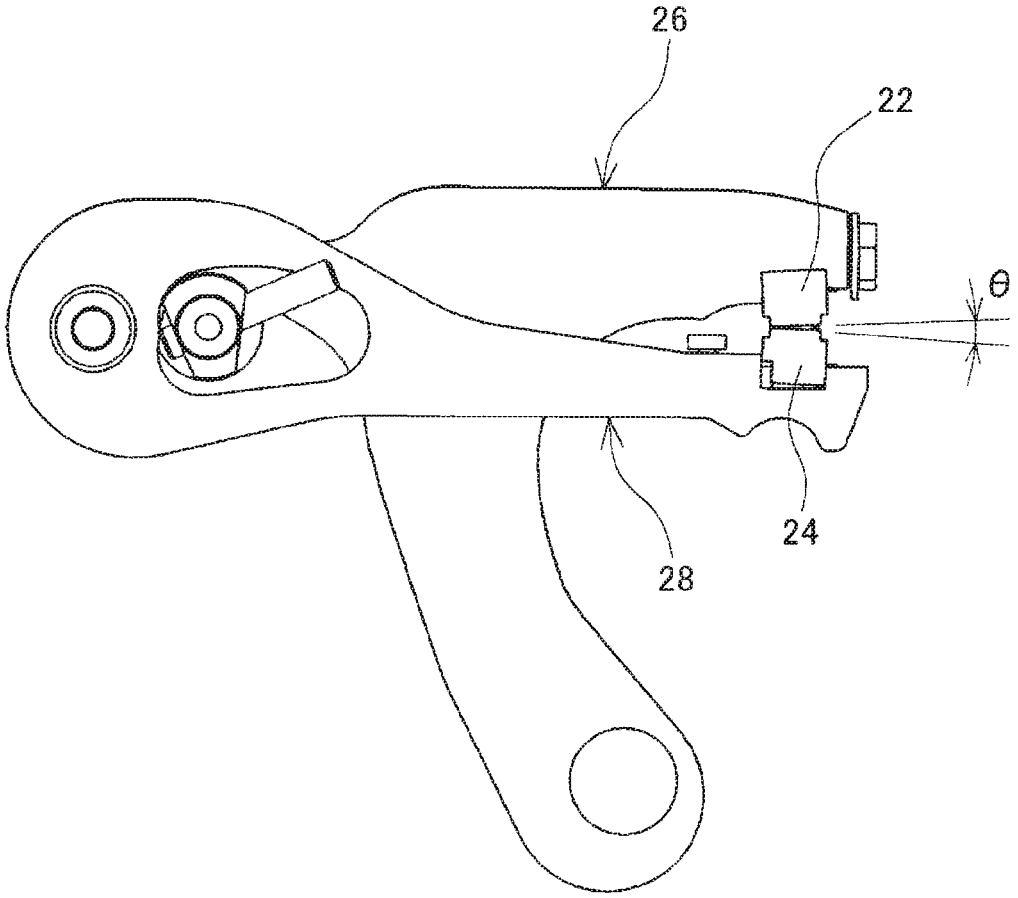
FIG. 19 is a side view of the binding operation unit when the upper tooth-shaped member and the lower tooth-shaped member have bitten each other.

FIG. 19 illustrates a state in which the upper teeth 100 and the lower teeth 102 bite deepest, that is, a state in which biting has been completed. As illustrated in FIG. 19, even at the completion of biting, the upper tooth-shaped member 22 and the lower tooth-shaped member 24 are tilted relative to each other. At this time, a tilting angle θ is, for example, more than 1.5°. In this way, in the recording-material binding device 10, the upper tooth-shaped member 22 and the lower tooth-shaped member 24 are constantly tilted from the beginning to the completion of biting.

In the recording-material binding device 10, the surfaces to which the upper tooth-shaped member 22 and the lower tooth-shaped member 24 are attached are inclined to tilt the upper tooth-shaped member 22 and the lower tooth-shaped member 24. In particular, the wedge shape of the upper shim 104 and the lower shim 106 is used to incline the surface of the upper shim 104 opposed to the bottom surface 22*a* of the upper tooth-shaped member 22 and the surface of the lower shim 106 opposed to the bottom surface 24*a* of the lower tooth-shaped member 24. By replacing both or one of the upper shim 104 and the lower shim 106 with a shim having a different wedge angle, the tilt of the upper tooth-shaped member 22 and the lower tooth-shaped member 24 is adjusted. Alternatively, only one of the upper shim 104 and the lower shim 106 may be provided. Further alternatively, one or both of the pedestal 26*d* of the upper arm 26 and the pedestal 28*e* of the lower arm 28 may be inclined without using any shim.

The recording-material binding device 10 is disposed so that the upper tooth-shaped member 22 and the lower tooth-shaped member 24 start biting from the side closer to edges of recording materials P on the accumulation tray 20. Since the upper tooth-shaped member 22 and the lower tooth-shaped member 24 are tilted, the recording materials P are drawn inward from the edges thereof during the biting process.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet binding device comprising:

a first tooth-shaped member that has a plurality of arranged teeth; and a second tooth-shaped member that has a plurality of arranged teeth, a wedge-shaped shim that comprises a first attachment surface to which the first tooth-shaped member or the second tooth-shaped member is attached; and wherein the second tooth-shaped member is configured to bite the first tooth-shaped member to clamp and bind sheets in cooperation with the first tooth-shaped member, and wherein the second tooth-shaped member is configured to be tilted relative to the first tooth-shaped member from a beginning of biting to a completion of biting.

2. The sheet binding device according to claim 1, further comprising:

a first arm that has a second attachment surface to which the first tooth-shaped member is attached; and a second arm that has a third attachment surface to which the second tooth-shaped member is attached, wherein the second arm is configured to cooperate with the first arm so that the first tooth-shaped member and the second tooth-shaped member bite each other, the third attachment surface being tilted relative to the second attachment surface so that the second tooth-shaped member is tilted relative to the first tooth-shaped member at the completion of the biting, wherein the first tooth-shaped member or the second tooth-shaped member to which the first attachment surface is attached is U-shaped, and wherein a surface of the first tooth-shaped member or the second tooth-shaped member to which the first attachment surface is attached corresponds to a horizontal portion of the U-shape.

3. The sheet binding device according to claim 2, wherein the wedge-shaped shim is disposed on a pedestal of the corresponding first or second arm, wherein the first tooth-shaped member or the second tooth-shaped member to which the first attachment surface is attached is positioned in a right-left direction with vertical portions of the U-shape being engaged with right and left side surfaces of the pedestal, and wherein the pedestal is provided at a distal end of the corresponding first or second arm.

4. The sheet binding device according to claim 1, wherein the sheet binding device further comprises:

a first arm that has a second attachment surface to which the first tooth-shaped member is attached; and a second arm that has a third attachment surface to which the second tooth-shaped member is attached, wherein the first tooth-shaped member or the second tooth-shaped member to which the first attachment surface is attached is U-shaped, wherein the first tooth-shaped member or the second tooth-shaped member to which the first attachment surface is attached is positioned in a right-left direction with vertical portions of the U-shape being engaged with right and left side surfaces of a pedestal, and wherein the pedestal is provided at a distal end of a corresponding one of the first arm or the second arm.

5. The sheet binding device according to claim 4, wherein the wedge shape of the shim is configured to incline the first attachment surface.

6. The sheet binding device according to claim 5, wherein the sheet binding device is configured such that the wedge-shaped shim may be replaced with a shim having a different wedge angle.

7. The sheet binding device according to claim 6, wherein the sheet binding device is configured such that replacing the wedge-shaped shim with the shim having a different wedge angle adjusts a tilt of the first tooth-shaped member or the second tooth-shaped member to which the first attachment surface was attached.

8. A sheet post-processing apparatus comprising:

a sheet accumulation unit configured to accumulate a plurality of rectangular sheets to form a sheet bundle; and the sheet binding device according to claim 1, wherein the first tooth-shaped member and the second tooth-shaped member are configured to start biting from a side close to an edge of the sheets accumulated in the sheet accumulation unit.

9. A sheet binding device comprising:

a first tooth-shaped member that has a plurality of arranged teeth; and a second tooth-shaped member that has a plurality of arranged teeth, wherein the second tooth-shaped member is configured to bite the first tooth-shaped member to clamp and bind sheets in cooperation with the first tooth-shaped member, and wherein the second tooth-shaped member is configured to be tilted relative to the first tooth-shaped member at an angle of more than 1.5° from a beginning of biting to a completion of biting.

* * * * *